US007093933B2

(12) United States Patent
Tsuji et al.

(10) Patent No.: US 7,093,933 B2
(45) Date of Patent: Aug. 22, 2006

(54) INK-JET PRINTER

(75) Inventors: Masaaki Tsuji, Wakayama (JP); Junichi Yamamoto, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 0 days.

(21) Appl. No.: 10/752,082

(22) Filed: Jan. 7, 2004

(65) Prior Publication Data

US 2004/0169711 A1 Sep. 2, 2004

(30) Foreign Application Priority Data

Jan. 10, 2003 (JP) ..... 2003-005133

(51) Int. Cl.
*B65H 20/00* (2006.01)

(52) U.S. Cl. ..... 347/104; 226/95; 400/619

(58) Field of Classification Search ..... 400/55, 400/611, 612, 619; 347/101, 104; 226/95
See application file for complete search history.

(56) References Cited

U.S. PATENT DOCUMENTS

| | | | | |
|---|---|---|---|---|
| 6,254,090 | B1 | 7/2001 | Rhodes et al. | |
| 6,406,017 | B1 * | 6/2002 | Yaneda | 271/276 |
| 6,604,820 | B1 * | 8/2003 | Fukuda | 347/104 |
| 6,739,489 | B1 * | 5/2004 | Nicolai et al. | 226/95 |
| 6,739,775 | B1 * | 5/2004 | Van Soest et al. | 400/579 |
| 2002/0044811 | A1 | 4/2002 | Regev et al. | |
| 2002/0109768 | A1 | 8/2002 | Greive | |

FOREIGN PATENT DOCUMENTS

| | | | |
|---|---|---|---|
| EP | 0 409 596 | B | 6/1994 |
| EP | 1223042 | A1 * | 7/2002 |
| JP | 3-29352 | U | 3/1991 |
| JP | 7-25083 | A | 1/1995 |
| JP | 2000-326574 | A | 11/2000 |

* cited by examiner

*Primary Examiner*—Daniel J. Colilla
*Assistant Examiner*—Jill E. Culler
(74) *Attorney, Agent, or Firm*—Smith Patent Office

(57) ABSTRACT

Many holes are formed in a platen that supports a paper. A suction fan generates suction force through these holes to thereby bring the paper into close contact with a surface of the platen. Ink ejection regions to which printing heads eject ink are set on a paper supporting side of the platen. The holes are formed in other regions in the platen than regions corresponding to vicinities of longitudinal ends of the ink ejection regions.

7 Claims, 5 Drawing Sheets

INK-JET PRINTER

BACKGROUND OF THE INVENTION

1. Field of the Invention

The present invention relates to an ink-jet printer that ejects ink onto a printing medium to perform printing.

2. Description of Related Art

Some ink-jet printers perform printing by ejecting ink onto a paper as a printing medium from a printing head that reciprocates perpendicularly to a paper conveyance direction. It is important, from the viewpoint of printing quality, to ensure flatness of the paper in a region confronting the printing head. Thus, particularly when a long paper is used as the printing medium, there may be adopted an approach in which many holes are formed in a platen that supports the paper in the region confronting the printing head and a suction fan disposed under the platen generates suction force through the holes to thereby bring the paper into close contact with a surface of the platen. The holes are, in general, formed in an entire surface of the platen in a substantially uniform pattern.

In such a printer, in association with a conveyance of the paper on the platen, the paper closes, among all the holes formed in the platen, the holes formed within an area where the paper passes during the conveyance thereof, i.e., within a paper passing area. The paper closes those holes sequentially from the ones disposed upstream in the paper conveyance direction. On the other hand, the holes formed outside the paper passing area are not closed with the paper, and therefore remain opened. When the suction fan drives in this condition, a large amount of air flows into the holes that remain opened. Therefore, there is a problem that, when such a printer performs printing onto vicinities of both edges of the paper in a direction perpendicular to the paper conveyance direction, airflow generated by the suction force of the suction fan leads away ink that is ejected by the printing head toward the vicinities of the edges of the paper, to result in decreased ink-landing accuracy and thus deterioration in printing quality.

SUMMARY OF THE INVENTION

An object of the present invention is to provide an ink-jet printer capable of ensuring flatness of a printing medium and at the same time restraining a decrease in ink-landing accuracy, even when, in particular, printing is performed onto vicinities of both edges of the printing medium in a direction perpendicular to a conveyance direction of the printing medium.

According to an aspect of the present invention, there is provided an ink-jet printer comprising: a conveyance mechanism that conveys a printing medium; an ink ejecting member capable of ejecting ink to an ink ejection region elongated in a direction substantially perpendicular to a conveyance direction of the conveyance mechanism; a supporting member that supports the printing medium in a region confronting the ink ejecting member and has the ink ejection region set on a printing medium supporting side thereof, the ink ejection region having at least one hole formed around a longitudinal center thereof and having no hole formed around both longitudinal ends thereof; and a suction member capable of sucking air through the hole from a printing medium supporting side of the supporting member to an opposite side thereof.

According to the aforementioned aspect, the hole is formed around the longitudinal center of the ink ejection region in the supporting member, and the suction member generates suction force through the hole so as to bring the printing medium into close contact with a surface of the supporting member to thereby ensure flatness of the printing medium. No hole is formed around both longitudinal ends of the ink ejection region in the supporting member. As a result, when the printing medium whose length in a direction perpendicular to the conveyance direction is a certain fixed length, here, a length corresponding to a region where the hole is formed, or more has printing performed onto vicinities of both edges thereof in the direction perpendicular to the conveyance direction, it can be prevented that airflow generated by the suction force of the suction member leads away ink that is ejected by the ink ejecting member toward the vicinities of the both edges of the printing medium. That is, according to the aforementioned aspect, flatness of the printing medium can be ensured and at the same time a decrease in inklanding accuracy can be restrained, even when printing is performed onto the vicinities of both edges of the printing medium in the direction perpendicular to the conveyance direction.

According to another aspect of the present invention, there is provided an ink-jet printer comprising: a conveyance mechanism that conveys a printing medium; an ink ejecting member capable of ejecting ink to an ink ejection region elongated in a direction substantially perpendicular to a conveyance direction of the conveyance mechanism; a supporting member that supports the printing medium in a region confronting the ink ejecting member and has the ink ejection region set on a printing medium supporting side thereof, no hole being formed in the ink ejection region, and at least one hole being formed in an area within a non ink ejection region other than the ink ejection region where the printing medium passes during its conveyance; and a suction member capable of sucking air through the hole from a printing medium supporting side of the supporting member to an opposite side thereof.

According to the aforementioned aspect, the hole is formed in the area within the non ink ejection region in the supporting member where the printing medium passes during its conveyance, and the suction member generates suction force through the hole so as to bring the printing medium into close contact with a surface of the supporting member to thereby ensure flatness of the printing medium. No hole is formed in the ink ejection region in the supporting member. As a result, regardless of a width of the printing medium, there may be obtained the same effects as mentioned above that flatness of the printing medium can be ensured and at the same time a decrease in ink-landing accuracy can be restrained, even when printing is performed onto vicinities of both edges of the printing medium in a direction perpendicular to the conveyance direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
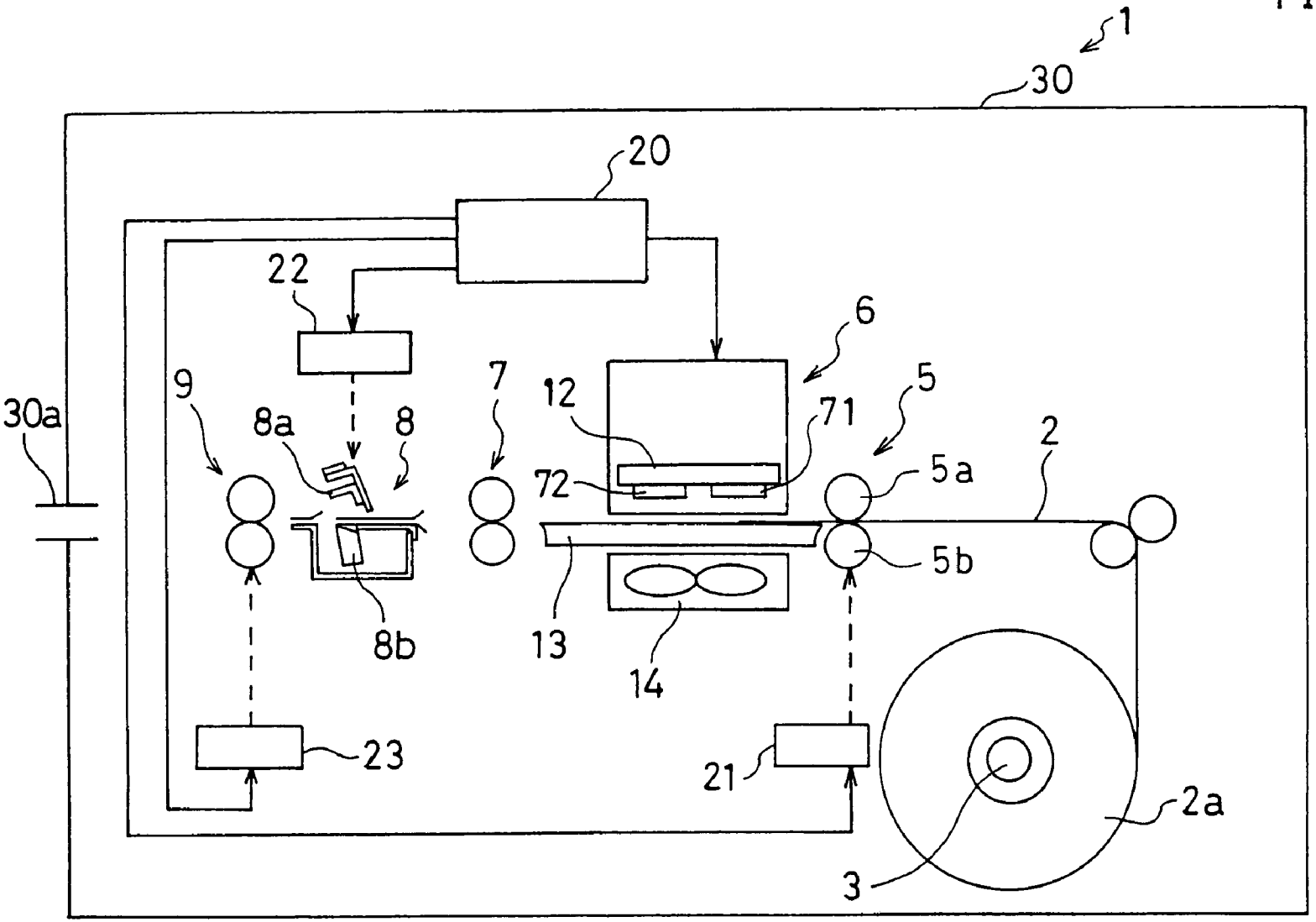
FIG. 1 schematically illustrates a construction of an ink-jet printer according to an embodiment of the present invention.

An ink-jet printer 1 illustrated in FIG. 1 has a substantially rectangular parallelepiped casing 30. The casing 30 includes therein a conveyance roller unit 5, an ink-jet printing unit 6, a press roller unit 7, a cutting unit 8, and a discharge roller unit 9 in this order from upstream in a paper conveyance direction. In the casing 30, additionally, arranged is a roll portion 2*a* formed by rolling a long paper 2 as a printing medium. The roll portion 2*a* is supported on a drum 3 so as to rotate around its axis. The conveyance roller unit 5, the press roller unit 7, and the discharge roller unit 9 constitute a conveyance mechanism that conveys the paper 2. A controller 20 disposed within the casing 30 controls an operation of each part of the ink-jet printer 1.

The conveyance roller unit 5 unwinds the paper 2 from the roll portion 2*a* to convey it downstream in the conveyance direction, then passes the paper 2 through the ink-jet printing unit 6, and then supplies the paper 2 to the press roller unit 7. The conveyance roller unit 5 has a pair of conveyance rollers comprising a drive roller 5*b* disposed under a paper conveyance path and a press roller 5*a* disposed over the paper conveyance path to press against the drive roller 5*b*. Both of the drive roller 5*b* and the press roller 5*a* are disposed with their axes being perpendicular to the paper conveyance direction, i.e., a direction perpendicular to the drawing sheet of FIG. 1. The drive roller 5*b* is rotated by a driving of a motor 21 controlled by the controller 20. The paper 2 is pinched with the drive roller 5*b* and the press roller 5*a* and, in this condition, conveyed in accordance with rotations of the drive roller 5*b*.

The ink-jet printing unit 6 has two printing heads 71 and 72 as an ink ejecting member, a carriage 12, a platen 13 as a supporting member, and a suction fan 14 as a suction member.

The two printing heads 71 and 72 are arranged at a predetermined distance from each other along the conveyance direction of the paper 2, i.e., a direction from right to left in FIGS. 1 to 5. Each of the printing heads 71 and 72 has, on its lower face or on its face confronting the paper 2, a large number of ejection nozzles 75 and 76 (see FIG. 2) for ejecting color inks such as yellow, magenta (purplish red), cyan (bluish green), and black. The printing heads 71 and 72 can, based on a signal from the controller 20, eject the color inks through the large number of ejection nozzles 75 and 76 onto a surface or an upper face in FIG. 1 of the paper 2 being conveyed, to thereby print a desired color image on the paper.

The ejection nozzles 75 and 76 in the printing heads 71 and 72 may arbitrarily be changed in number and arrangement. The printing heads 71 and 72 may have ejection nozzles that eject plural color inks, color combination of which is other than the aforementioned, or may have a large number of ejection nozzles for only black ink to print a monochrome image. The ink-jet printing unit 6 may be a piezo-jet type, a thermal-jet type, or any other types, as long as ejecting liquid ink through nozzles dot by dot to perform printing on the paper 2.

The carriage 12 holds the two printing heads 71 and 72 on its lower face such that the printing heads 71 and 72 may confront the paper 2. The carriage 12 is, together with the printing heads 71 and 72, reciprocatable perpendicularly to the paper conveyance direction. The printing heads 71 and 72 held by the carriage 12 eject ink onto the surface of the paper 2 while reciprocating with the carriage 12 perpendicularly to the paper conveyance direction.

The platen 13 supports the paper 2 in a region confronting the printing heads 71 and 72. A surface, an upper face in FIG. 1, of the platen 13 serves as a paper supporting side as a printing medium supporting side that is substantially on the same plane as a conveyance surface for the paper 2. Thus, the printing heads 71 and 72 perform printing on the paper 2 arranged on the platen 13 while, in a state of confronting the surface of the platen 13, reciprocating along a widthwise direction of the platen 13.

Figure 2:
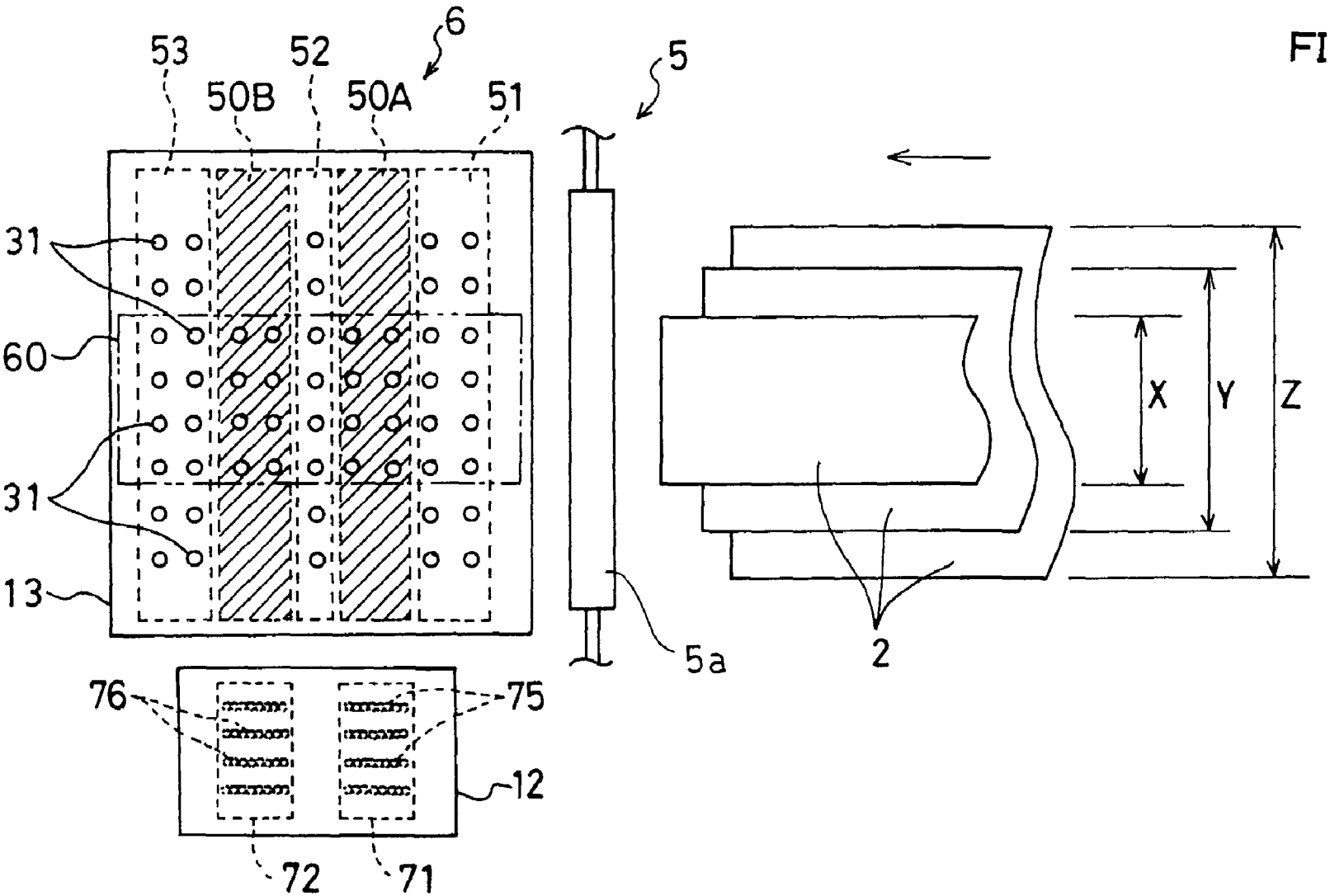
FIG. 2 is a partial top view around a platen in the ink-jet printer of FIG. 1.

Ink ejection regions 50A and 50B as patterned with oblique lines in FIG. 2 are set on a part of the surface of the platen 13. The ink ejection regions 50A and 50B are regions, among regions over which the two printing heads 71 and 72 pass, where the respective printing heads 71 and 72 can eject ink. Each of the ink ejection regions 50A and 50B is an elongated band-like region with its length in the paper conveyance direction being equal to that of the printing head 71 or 72 and its length in a direction perpendicular to the paper conveyance direction being substantially equal to an entire width of the platen 13. The two ink ejection regions 50A and 50B are, similarly to the two printing heads 71 and 72, at a predetermined distance from each other along the paper conveyance direction.

In the following, regions in the surface of the platen 13 other than the ink ejection regions 50A and 50B, i.e., non ink ejection regions are referred to as a first suction region 51, a second suction region 52, and a third suction region 53 in this order from upstream in the paper conveyance direction. Each of the regions 51 to 53 is shown enclosed with a broken line in FIGS. 2 to 5. The ink ejection regions 50A and 50B are sandwiched between the first and second suction regions 51 and 52 and between the second and third suction regions 52 and 53, respectively, in the paper conveyance direction.

In the first to third suction regions 51 to 53 in the platen 13, many substantially circular holes 31 all having the same size are uniformly formed substantially over the entire width of the platen 13. In the ink ejection regions 50A and 50B in the platen 13, on the other hand, the holes 31 are formed only around longitudinal centers of the ink ejection regions 50A and 50B. No hole 31 is formed around both longitudinal ends of the respective ink ejection regions 50A and 50B. More specifically, in the ink ejection regions 50A and 50B in the platen 13, the holes 31 are formed only within a minimum paper passing area 60 or an area illustrated with an alternate long and two dashes line in FIG. 2 as will be described later.

In this embodiment, as illustrated in FIG. 2, objects to be printed are the papers 2 having three different widths X, Y, and Z ($X<Y<Z$). An area where the paper 2 having the minimum width X passes during its conveyance is referred to as the minimum paper passing area 60. The paper 2 having each width is conveyed with a widthwise center thereof aligning with a widthwise center of the platen 13. Thus, the minimum paper passing area 60 is included in a passing area of the paper 2 having any of the widths X, Y, and Z, which is the object to be printed in this embodiment.

The suction fan 14 is, as illustrated in FIG. 1, disposed at a position confronting the printing heads 71 and 72 across the conveyance path of the paper 2 and the platen 13, i.e., at a position on a back face side or lower face side in FIG. 1 of the paper 2. The suction fan 14 can suck air through the holes 31 from the top face side to the back face side of the platen 13. The paper 2 having reached the ink-jet printing unit 6 is brought into close contact with the surface of the platen 13 by means of suction force of the suction fan 14, and is conveyed with a distance from the printing heads 71 and 72 kept fixed. This can prevent deterioration in printing quality caused by change in distance between the paper 2 and the printing heads 71 and 72 when the paper 2 is curled to thereby partially get apart from the platen 13 to a larger extent.

The press roller unit 7 pinches and conveys the paper 2 that is conveyed from the ink-jet printing unit 6 to the cutting unit 8. The press roller unit 7 is disposed between the ink-jet printing unit 6 and the cutting unit 8, so that printing by the ink-jet printing unit 6 and cutting of the paper 2 by the cutting unit 8 can properly be performed.

The cutting unit 8 has a movable cutting blade 8*a* disposed on the same side of the paper 2 as the printing heads 71 and 72, and a fixed cutting blade 8*b* disposed on the opposite side of the paper 2 to the movable cutting blade 8*a*. Each of the movable cutting blade 8*a* and the fixed cutting blade 8*b* is a rectangular-shaped blade having a width somewhat larger than the width Z. The movable cutting blade 8*a* is movable to get closer to or apart from the fixed cutting blade 8*b* by a driving of a motor 22 controlled by the controller 20. Thus, the movable cutting blade 8*a* cooperates with the fixed cutting blade 8*b* to cut the printed paper 2, which have been conveyed to the cutting unit 8, along a widthwise direction of the paper 2. The printed paper 2 is thus cut into predetermined lengths.

The discharge roller unit 9 includes a pair of drive rollers driven by a motor 23 controlled by the controller 20, and conveys the paper 2 having cut by the cutting unit 8 to discharge them through a discharge port 30*a*.

The controller 20 subjects an image signal supplied from a non-illustrated input interface to a predetermined process, and then supplies, to the ink-jet printing unit 6, a print signal including image data corresponding to an image to be printed. The controller 20 also controls timings for conveying the paper 2 at the conveyance roller unit 5 and at the discharge roller unit 9, a timing for moving the carriage 12, a timing for ejecting ink from the printing heads 71 and 72, a timing for cutting the paper 2 at the cutting unit 8, and the like.

Figure 3:
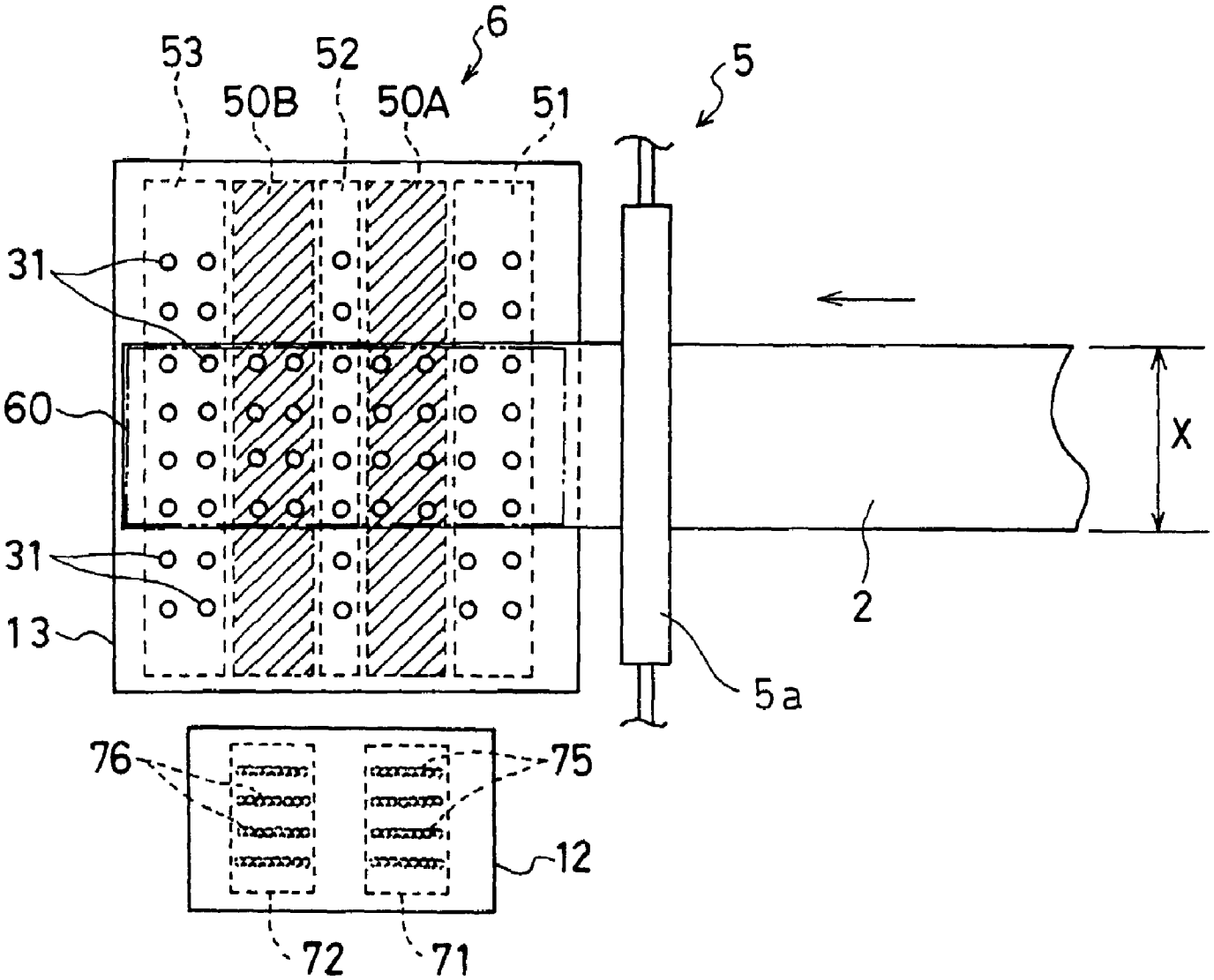
FIG. 3 is an explanatory view illustrating that the ink-jet printer of FIG. 1 performs a printing operation on a paper having a width X.
Figure 4:
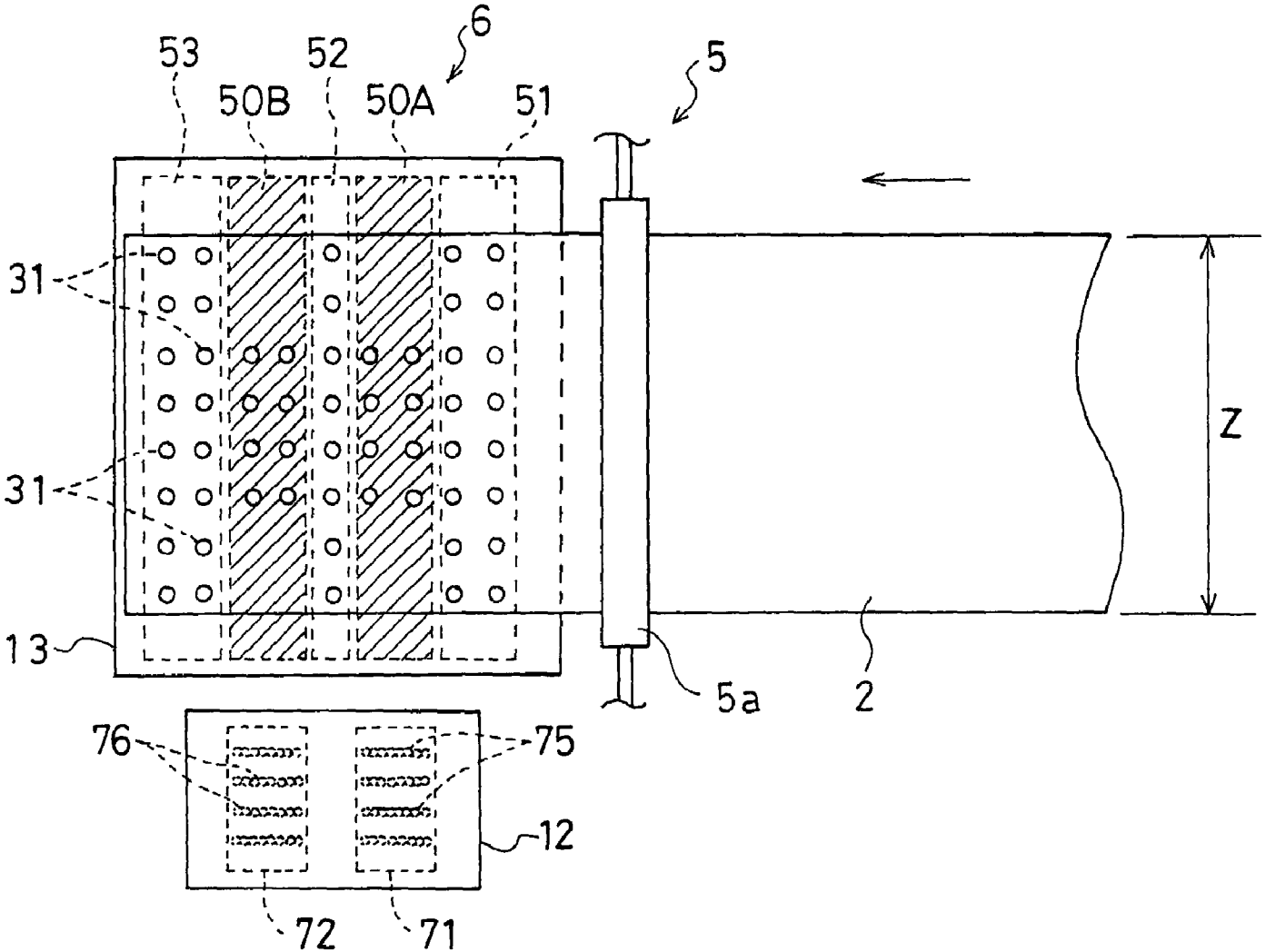
FIG. 4 is an explanatory view illustrating that the ink-jet printer of FIG. 1 performs a printing operation on a paper having a width Z.

Next, descriptions will be given, with reference to FIGS. 3 and 4, to how the ink-jet printer 1 performs a printing operation on the papers 2 having the respective widths X and Z.

The motor illustrated in FIG. 1 drives to rotate the pair of conveyance rollers of the conveyance roller unit 5, so that the paper 2 is unwound from the roll portion 2*a* and conveyed onto the platen 13. When a leading edge of the paper 2 arrives at the ink ejection regions 50A and 50B (see FIG. 2) in the platen 13, the printing heads 71 and 72 start reciprocating perpendicularly to the paper conveyance direction. The paper 2 is kept stopping during a reciprocation of the printing heads 71 and 72, and conveyed in the paper conveyance direction by a predetermined feeding amount when the printing heads 71 and 72 are temporarily stopping before starting every forward or backward movement thereof. That is, a forward or backward movement of the printing heads 71 and 72 and a conveyance of the paper 2 by the predetermined feeding amount are alternately repeated. The printing heads 71 and 72 eject ink onto the paper 2 during their reciprocations to thereby perform printing.

In association with a conveyance of the paper 2 having the width X on the platen 13, the paper 2 closes, among all the holes 31 formed in the platen 13, the holes 31 disposed within the minimum paper passing area 60 sequentially from the ones located upstream in the paper conveyance direction, while the holes 31 disposed outside the minimum paper passing area 60 are kept opened. FIG. 3 illustrates a state where a leading edge of the paper 2 having the width X has almost reached an end of the platen 13 on a downstream side in the paper conveyance direction. At this time, the paper 2 is in close contact with the surface of the platen 13 by means of the suction force of the suction fan 14 (see FIG. 1) through the holes 31 formed in the ink ejection regions 50A and 50B in the platen 13 and through, among the holes 31 formed in the first to third suction regions 51 to 53 in the platen 13, the holes 31 formed within the minimum paper passing area 60. Like this, after the leading edge of the paper 2 having the width X reaches the platen 13, the paper 2 receives uniform suction force substantially over its whole surface disposed on the platen 13, and is conveyed in a state of close contact with the surface of the platen 13.

The holes 31 that are always kept opened in the course of the conveyance of the paper 2 with the width X are formed in the first to third suction regions 51 to 53, not in the ink ejection regions 50A and 50B.

On the other hand, in association with a conveyance of the paper 2 having the width Z on the platen 13, the paper 2 closes, among all the holes 31 formed in the plate 13, the holes 31 disposed within the passing area of the paper 2 having the width Z, i.e., all the holes 31, sequentially from the ones located upstream in the paper conveyance direction. FIG. 4 illustrates a state where a leading edge of the paper 2 having the width Z has almost reached an end of the platen 13 on a downstream side in the paper conveyance direction. At this time, the paper 2 is in close contact with the surface of the platen 13 by means of the suction force of the suction fan 14 (see FIG. 1) through all the holes 31 formed in the platen 13.

Since no hole 31 is formed around the longitudinal ends of the ink ejection regions 50A and 50B in the platen 13, the paper 2 having the width Z receives no suction force thereat. However, the holes 31 are formed on upstream and downstream vicinities of these portions of the ink ejection regions 50A and 50B having no hole 31 formed therein. That is, the holes 31 are formed around longitudinal ends of the first to third suction regions 51 to 53, where the suction force is generated. Thus, after the leading edge of the paper 2 having the width Z reaches the platen 13, the paper 2 receives sufficient suction force for ensuring its flatness, and is conveyed in a state of close contact with the surface of the platen 13.

As described above, according to the ink-jet printer 1, the holes 31 are formed in the platen 13, and the suction fan 14 generates the suction force through the holes 31 so as to bring the paper 2 into close contact with a surface of the platen 13 to thereby ensure flatness of the paper 2. No hole 31 is formed around the longitudinal ends of the ink ejection regions 50A and 50B in the platen 13. As a result, when the paper 2 whose length in the direction perpendicular to the conveyance direction is a certain fixed length, here, a length corresponding to a region where the holes 31 are formed, or more, i.e., the paper 2 whose width is X or more in this embodiment, has printing performed onto vicinities of both edges thereof in the direction perpendicular to the conveyance direction; it can be prevented that airflow generated by the suction force of the suction fan 14 leads away ink that is ejected by the printing heads 71 and 72 toward the vicinities of both edges of the paper 2. In this embodiment, since the width X is set as a minimum size, this effect can be obtained for all the paper 2 to be printed by the printer 1. Thus, according to this embodiment, flatness of the paper 2 can be ensured and at the same time a decrease in ink-landing accuracy can be restrained, even when printing is performed onto the vicinities of the both edges of the paper 2 in the direction perpendicular to its conveyance direction.

In order to obtain these effects, it is also conceivable to form many holes in the entire surface of the platen in a substantially uniform pattern, and suitably close the holes located outside the both edges of the paper 2 in the direction perpendicular to the paper conveyance direction. In this case, however, a complicated mechanism for closing the holes is required. On the other hand, this embodiment can provide the above-mentioned effects without any complicated mechanism.

In addition, since the holes 31 are formed also in the first to third suction regions 51 to 53 in the platen 13, the paper 2 arranged on the platen 13 receives the suction force through the holes 31 formed in the first to third suction regions 51 to 53 as well as the holes 31 formed in the ink ejection regions 50A and 50B. Therefore, flatness of the paper 2 on the platen 13 may more surely be ensured.

Moreover, the ink ejection region 50A is sandwiched between the first suction region 51 and the second suction region 52, and the ink ejection region 50B is sandwiched between the second suction region 52 and the third suction region 53. Besides, the holes 31 are formed in all of the first to third suction regions 51 to 53 in the platen 13. Therefore, flatness of the paper 2 on the platen 13 may further surely be ensured. This is because regions having the holes 31 formed therein exist in the upstream and downstream vicinities of the respective ink ejection regions 50A and 50B, so that the paper 2 receives the suction force widely and uniformly over its plane.

Further, the printing heads 71 and 72 are so-called serial-type heads that can eject ink to the ink ejection regions 50A and 50B by moving substantially perpendicularly to the conveyance direction of the paper conveyed by the conveyance roller unit 5. Accordingly, compared with a fixed line-type head, the printing heads 71 and 72 can be downsized. This leads to downsizing of the printer 1.

The number, a shape, and a position of the holes formed in the platen are not limited to the ones in the aforementioned embodiment, but may variously be changed as follows.

For example, the shape of the hole is not limited to a substantially circular shape, but may be an oval shape, etc.

As for the position of the hole, in the aforementioned embodiment, the holes are formed also in the non ink ejection regions, i.e., the first to third suction regions 51 to 53, other than the ink ejection regions 50A and 50B in the platen 13. However, the holes may not be formed in the non ink ejection regions and may be formed only around the longitudinal centers of the ink ejection regions 50A and 50B. Even though the holes are to be formed in the non ink ejection regions, it is not always necessary to form the holes in both the upstream and the downstream vicinities of the respective ink ejection regions 50A and 50B as in the aforementioned embodiment. For example, the holes may be formed in only one of the upstream vicinities and the downstream vicinities of the respective ink ejection regions 50A and 50B. Moreover, the holes may not necessarily be formed uniformly in the whole of the non ink ejection regions. The holes may be formed only within the paper passing area in the non ink ejection regions.

Figure 5:
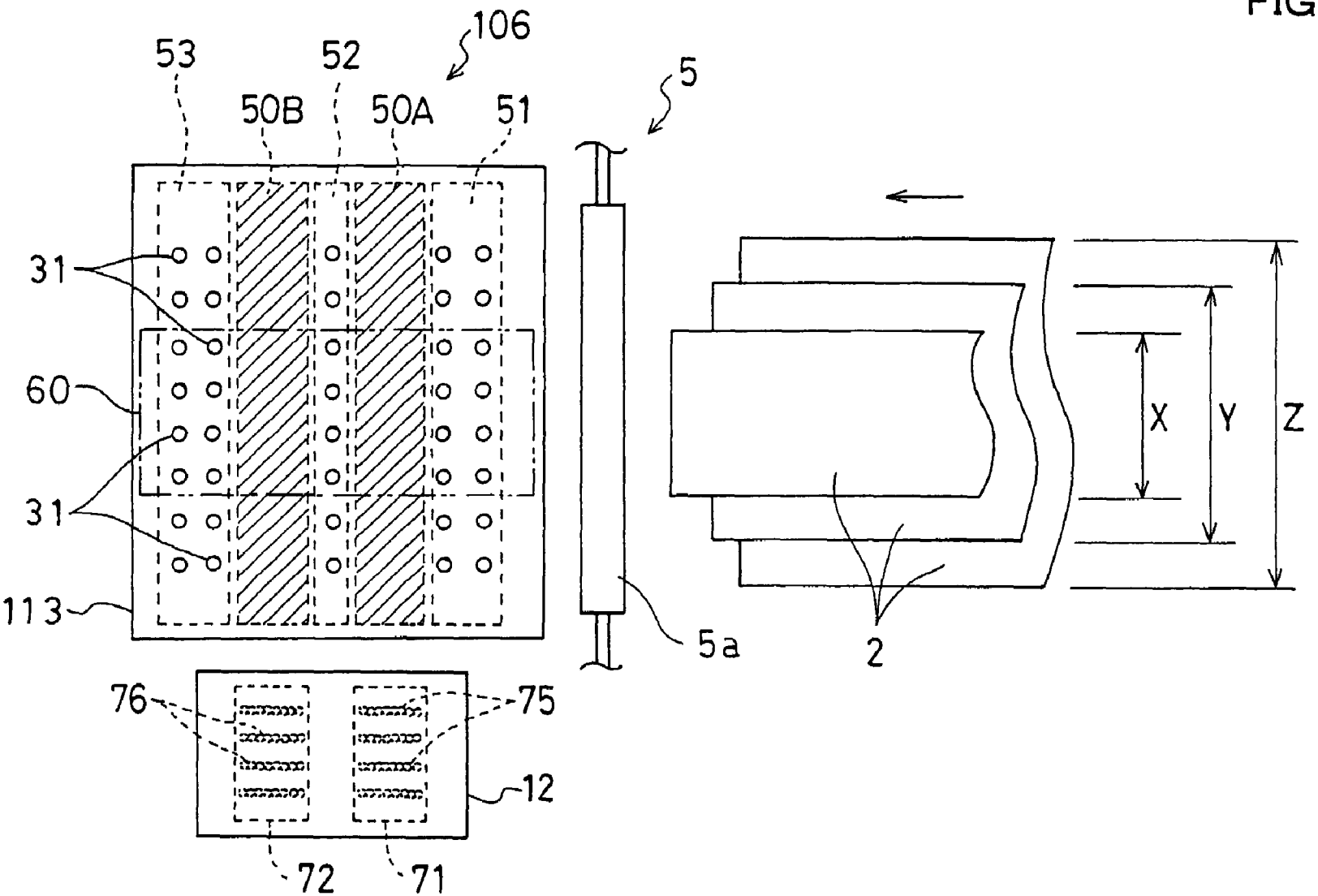
FIG. 5 is a partial top view showing a modification of the platen.

More specifically, a possible modification of the platen is shown in FIG. 5. A platen 113 illustrated in FIG. 5 is to be included in the same ink-jet printing unit 106 as in the aforementioned embodiment. Similarly to the platen 13, the platen 113 has ink ejection regions 50A and 50B and first to third suction regions 51 to 53 set on a surface thereof. In addition, the same components as in the aforementioned embodiment are denoted by the same reference numerals to thereby omit a description thereof. In the platen 113 illustrated in FIG. 5, holes 31 are formed in the first to third suction regions 51 to 53 similarly to the platen 13 of the aforementioned embodiment, while no hole 31 is formed in the ink ejection regions 50A and 50B. Accordingly, a paper 2 being conveyed on the platen 113 receives suction force through the holes 31 formed only in non ink ejection regions, i.e., in the first to third suction regions 51 to 53. According to this construction, when printing is performed onto vicinities of both edges of the paper 2 in the direction perpendicular to its conveyance direction, a decrease in ink-landing accuracy can be restrained regardless of a width of the paper 2.

Moreover, the ink ejection region set on the surface of the platen may arbitrarily be changed in number, too.

Further, although the aforementioned embodiment illustrates that the paper is conveyed in a single line, the present invention may also be applied to a case where plural papers are conveyed in parallel with each other, so as to obtain the same effects as described above. For example, ink ejection regions corresponding to respective papers to be conveyed in parallel are set on a surface of a platen, in which holes are formed only around longitudinal centers of the respective ink ejection regions as in the aforementioned embodiment, or alternatively in which holes are formed only in non ink ejection regions as in the modification of FIG. 5.

Still further, although the aforementioned embodiment illustrates that printing is performed onto the long paper 2 that has been unwound from the roll portion 2*a* and then conveyed, cut papers with a predetermined length may be conveyed to be printed thereon.

Various media such as thin plastics, instead of papers, may be adopted as a printing medium for the ink-jet printer of the present invention.

Still further, an application of the present invention is not limited to a so-called serial-type printer in which, as in the aforementioned embodiment, printing is performed with the printing heads 71 and 72 that reciprocate perpendicularly to the paper conveyance direction. The present invention is applicable also to a line-type printer that performs printing with a fixed printing head.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet printer comprising:

a conveyance mechanism that conveys a printing medium;

an ink ejecting member capable of ejecting ink to an ink ejection region extending in a direction substantially perpendicular to a conveyance direction of the conveyance mechanism;

a supporting member that supports the printing medium in a region confronting the ink ejecting member and has the ink ejection region set on a printing medium supporting side thereof, no hole being formed in the ink ejection region, and at least one hole being formed in an area within a non ink ejection region other than the ink ejection region; and a suction member capable of sucking air through the hole from a printing medium supporting side of the supporting member to an opposite side thereof.

2. The ink-jet printer according to claim 1, wherein the ink ejecting member is capable of ejecting ink to the ink ejection region by moving substantially perpendicularly to the conveyance direction of the conveyance mechanism.

3. An ink-jet printer comprising:

a conveyance mechanism adapted to convey lengthwise printing mediums of various widths;

an ink ejecting member capable of ejecting ink onto the printing medium;

a supporting member that supports the printing medium, the supporting member having an ink ejection region corresponding to a region where ink is applied to the printing medium, the ink ejection region consisting of a first area having at least one hole formed in the supporting member and the first area having a substantially constant width less than half of the width of the supporting member and defining a minimum paper passing area and a second area where no hole is formed in the supporting member, the second area being provided outside of and on at least one side of the first area; and a suction member capable of sucking air through the hole from one side of the supporting member to the other side thereof.

4. The ink-jet printer according to claim 3, further comprises a non ink ejection region adjacent to the ink ejection region in the supporting member, wherein the non ink ejection region has at least one hole.

5. The ink-jet printer according to claim 4, wherein:

the ink ejection region is disposed between the non ink ejection regions; and at least one hole is formed in each of the non ink ejection regions in the supporting member.

6. The inkjet printer according to claim 4, wherein:

the non ink ejection region has at least one hole in a portion adjacent to the second area of the ink ejection region.

7. The ink-jet printer according to claim 3, wherein the ink ejecting member is capable of ejecting ink onto the printing medium by moving substantially perpendicularly to the conveyance direction of the conveyance mechanism.

* * * * *